United States Patent [19]

Taylor, Jr.

[11] Patent Number: 4,719,700

[45] Date of Patent: Jan. 19, 1988

[54] KNIFE OPENING MECHANISM

[76] Inventor: William J. Taylor, Jr., 828 Sycamore Dr., Decatur, Ga. 30030

[21] Appl. No.: 878,791

[22] Filed: Jun. 26, 1986

[51] Int. Cl.[4] ..... B26B 3/06

[52] U.S. Cl. ..... 30/158; 30/160

[58] Field of Search ..... 30/158, 159, 160

[56] References Cited

U.S. PATENT DOCUMENTS

| | | | |
|---|---|---|---|
| 551,052 | 12/1895 | Shonnard et al. | 30/159 |
| 698,080 | 4/1902 | Treas | 30/159 |
| 1,553,985 | 4/1925 | Ciesnierski | 30/162 |
| 1,603,914 | 10/1926 | Hermann | 30/159 |
| 2,416,277 | 11/1945 | Siegel | 30/158 |
| 2,601,999 | 7/1952 | Sly | 30/159 X |
| 2,808,646 | 10/1957 | Lohr | 30/159 |

FOREIGN PATENT DOCUMENTS

| | | | |
|---|---|---|---|
| 19327 | of 1896 | United Kingdom | 30/158 |
| 186607 | 9/1922 | United Kingdom | 30/159 |

*Primary Examiner*—E. R. Kazenske
*Assistant Examiner*—Michael D. Folkerts
*Attorney, Agent, or Firm*—Jones, Askew & Lunsford

[57] ABSTRACT

A knife of the type having a casing and a blade pivotably mounted thereto has an actuator button slidably mounted to the casing. The blade has a concentric wheel associated therewith. One end of a non-extensible linkage is connected to the actuator, and the opposite end of the non-extensible linkage is wrapped around a portion of the wheel. When the user exerts a force to slide the actuator, the user-exerted force is transmitted by the non-extensible linkage to rotate the wheel, thereby pivoting the blade from its closed position to its open position.

7 Claims, 7 Drawing Figures

KNIFE OPENING MECHANISM

TECHNICAL FIELD

This invention relates generally to folding knives, and relates more specifically to drive mechanisms for opening the knife blade with respect to the casing.

BACKGROUND OF THE INVENTION

Folding knives having mechanical drives for opening a pivotally mounted knife blade are known in the art. One such example is found in U.S. Pat. No. 2,416,277, which discloses a knife opened with a simple rack gear arrangement. A longitudinally disposed actuating member is slidably mounted within the casing and has a handle protruding from one end of the casing. The blade is rotatably mounted at the opposite end of the casing. A plurality of gear teeth formed along one edge of the actuating member engage corresponding gear teeth formed on the pivoting end of the blade. When the handle of the actuating member and the casing are pulled in opposite directions, the actuating member slides within the casing, and the gear teeth on the actuating member engage the gear teeth on the knife blade to pivotally open the blade with respect to the casing.

However, this design suffers a number of disadvantages. First, the actuating member protrudes from the casing at all times, increasing the overall length of what is supposed to be a compact instrument. Also, the action of pulling the casing and the handle of the actuating member in opposite directions requires two hands to operate the knife. Furthermore, with the knife blade pivoted to its opened position, the actuating member protrudes awkwardly from the opposite end of the casing in such a manner as may instruct or impede the use of the knife. Finally, the knife lacks any provision for locking the blade in its closed position to prevent accidental opening.

Another example of a knife opening mechanism is found in U.S. Pat. No. 1,553,985, wherein a bayonet slidably mounted within a rifle forestock is extensible upon actuation of a crank. The pivotally mounted crank has a handle and a plurality of gear teeth disposed to engage a corresponding gear rack found on the shank of the bayonet. Thus, as the crank handle is turned, the teeth on the crank drive the rack on the bayonet to extend or retract the bayonet from the forestock.

Adapting this design to a folding pocket knife would present many of the same disadvantages previously mentioned. The crank handle would protrude awkwardly from the casing, increasing the overall dimensions of the knife. Further, cranking the handle to extend the knife blade would be a two-handed operation. Finally, there is no provision for locking the blade in its closed position to prevent accidental opening.

A different kind of self-opening knife is the so-called "switchblade" knife. These knives have spring-powered blades which rapidly move open at the touch of a release button. The possession of a switchblade knife is unlawful in many jurisdictions.

Accordingly, there is a need to provide an improved knife opening mechanism which can be actuated to extend the knife blade with only one hand, and which does not substantially increase the external dimensions of the knife.

SUMMARY OF THE INVENTION

As will be seen, the present invention overcomes these and other disadvantages associated with the prior art knife opening mechanisms. Stated generally, the knife opening apparatus of the present invention comprises a positive drive mechanism mechanically connected to the knife blade and operable upon manual actuation of an opening member to pivot the blade to an open position. The knife opening mechanism further includes a locking member to latch the blade in the closed position, the locking member being selectively disengaged upon actuation of the knife opening mechanism to permit the blade to pivot open.

Stated more specifically, the knife opening mechanism in one embodiment of the present invention includes a thumb-operated slide button mounted on the side of the knife casing. One end of a cable is linked to the slide button, and the other end of the cable is wrapped around a wheel connected to the pivoting end of the knife blade. A locking member mechanically connected to the slide button normally engages the wheel to prevent the blade from accidental opening. As the slide button is actuated, the locking member is disengaged from the wheel, freeing the wheel to pivot. Further actuation of the slide button pulls the cable wrapped around the wheel, turning the wheel and pivoting the knife blade out of its casing.

An alternate embodiment includes a slide button on the side of the knife casing and connected to a gear rack. Teeth on the gear rack engage a toothed pinion, which in turn engages an intermediate gear, which in turn engages a blade gear fixedly mounted to the pivoting knife blade. As the slide button is actuated, the rack drives the pinion, which drives the intermediate gear and, in turn, the blade gear to pivot the blade out of the casing into an open position.

Thus, it is an object of the present invention to provide a knife with an improved opening mechanism.

It is another object of this invention to provide a knife opening mechanism which does not substantially increase the external dimensions of the knife.

It is a further object of the present invention to provide a knife opening mechanism which can be actuated to extend the knife blade with only one hand.

It is another object of the present invention to provide a knife opening mechanism which locks the knife blade in its closed position to prevent accidental extension of the blade from the casing.

It is a further object of the present invention to provide a knife opening mechanism which opens the blade of a folding knife in response to manual movement of a control member, without using a spring to power the blade open.

Other objects, features, and advantages of the present invention will become apparent upon reading the following specification when taken into conjunction with the drawings and the appended claims.

DETAILED DESCRIPTION OF THE DISCLOSED EMBODIMENTS

Figure 1:
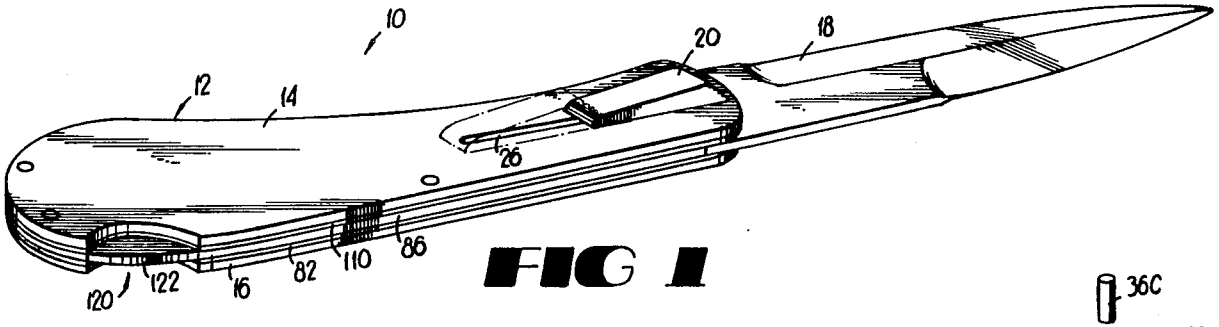
FIG. 1 is a pictorial view of a knife including a knife opening mechanism according to a preferred embodiment of the present invention.

Referring now in more detail to the drawing, in which like numerals indicate like elements throughout the several views, FIGS. 1–5 show a knife 10 including a knife opening mechanism according to the present invention. The knife 10 includes a casing 12 comprising opposing housing sections 14, 16; a blade 18; and an actuator button 20 for actuating the knife opening mechanism as will be explained herein.

Figure 2:
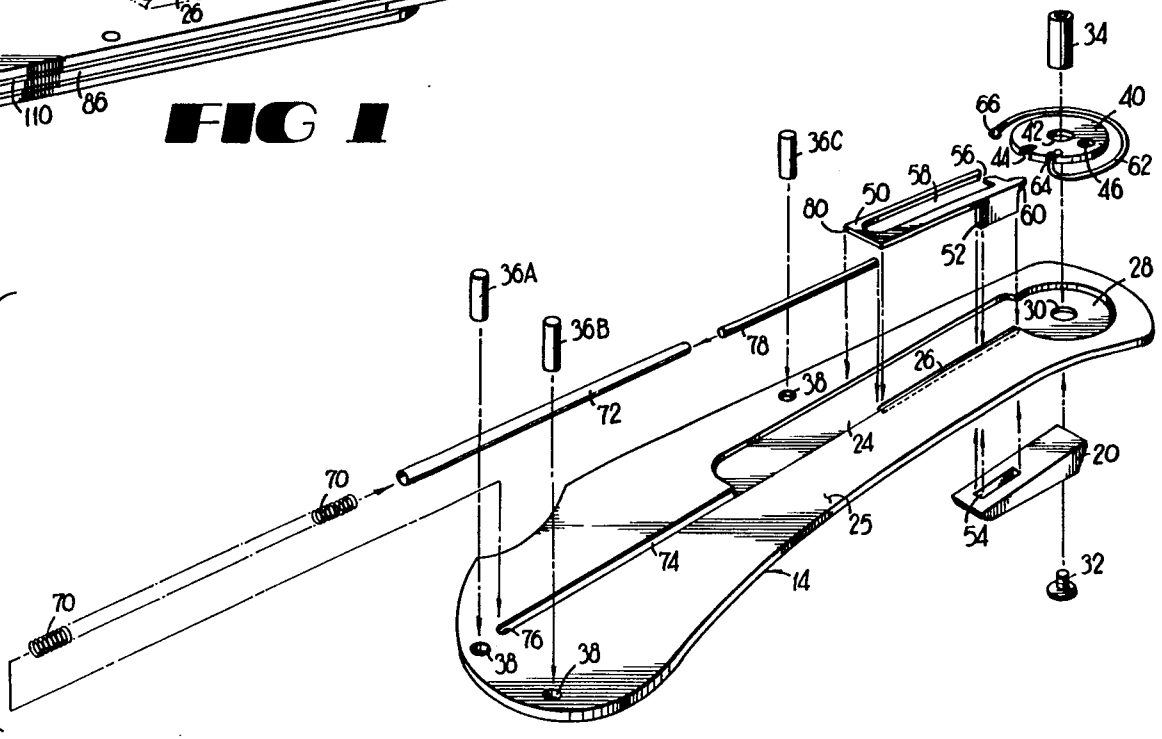
FIG. 2 is a pictorial view of a portion of the casing of the knife of FIG. 1 with the knife opening mechanism exploded therefrom.

Referring now to FIG. 2, one housing section 14 has a recess 24 formed on its inner face 25. A slot 26 is formed through the housing section 14 in communication with the recess 24 and extending to the outer side of the housing section. The recess 24 has a generally circular portion 28 at one end thereof. A bore 30 is formed through the housing 14 concentric with the circular section 28 of the recess 24. The threaded shank of a screw 32 is received through the bore 30 to anchor a pivot post 34 to protrude upwardly of the circular portion 28 of the recess 24. A plurality of guide pins 36A, 36B, 36C are inserted through corresponding holes 38 in the housing section 14 to project upwardly therefrom.

A wheel 40 has a bore 42 for mounting the wheel on the pivot post 34 for rotation within the circular section 28 of the recess 24. The wheel 40 has a detent 44 formed in its circumference, and a hole 46 is formed in the wheel off-center and parallel to the axis of rotation thereof.

An actuator 50 is slidably received within the recess 24. A post 52 depending downwardly from the actuator 50 protrudes through the slot 26 in the housing section 14. The actuator button 20, located on the outer side of the housing section 14, is mounted to the post 52 of the actuator 50 by means of a corresponding slot 54 formed on the inner face of the button. The actuator 50 covers the slot 26 when not in use, i.e., when the actuator is in the full-forward position shown in FIG. 2, preventing dirt from entering the mechanism within the housing.

The actuator 50 is substantially U-shaped, with a narrow slot 56 in the top of the "U" opening into a longitudinal channel 58. One of the legs of the "U" has an outer end comprising a locking member 60 dimensioned to be received within the detent 44 in the circumference of the wheel 40.

A cable 62 has one end 64 secured to the rim of the wheel 40. The cable 62 in the present embodiment is made of wirestrands, although other kinds of flexible tension drive links such as roller chains, belts, or the like can also be used. The cable is wrapped around a portion of the circumference of the wheel 40 and has a ferrule 66 attached to the other end thereof. The cable 62 is threaded into the slot 56 in the actuator 50. The ferrule 66 is small enough to slide freely within the longitudinal channel 58 but is too large to be withdrawn through the slot 56. As the actuator 50 slides within the recess 24 in a direction away from the wheel 40, the cable 62 is pulled, causing the wheel 40 to rotate about the mounting post 34 in a counterclockwise direction as viewed in FIGS. 2–5. The one end 64 of the cable 62 has a ferrule which engages a recess near the periphery of the wheel 40. The periphery of the wheel can optionally be grooved to help accommodate the cable 62 wrapped around the wheel.

Again referring to FIG. 2, a coil spring 70 is slidably received within an elongated cylindrical housing 72. The housing 72 is mounted within a narrow portion 74 of the recess 24 so that the coil spring 70 bears against the end 76 of the recess. One end of a plunger 78 is slidably inserted into the other end of the housing 72, the other end of the plunger bearing against the back end 80 of the actuator 50. In this manner, the spring 70 acts upon the plunger 78 to bias the actuator 50 toward the wheel 40.

Figure 3:
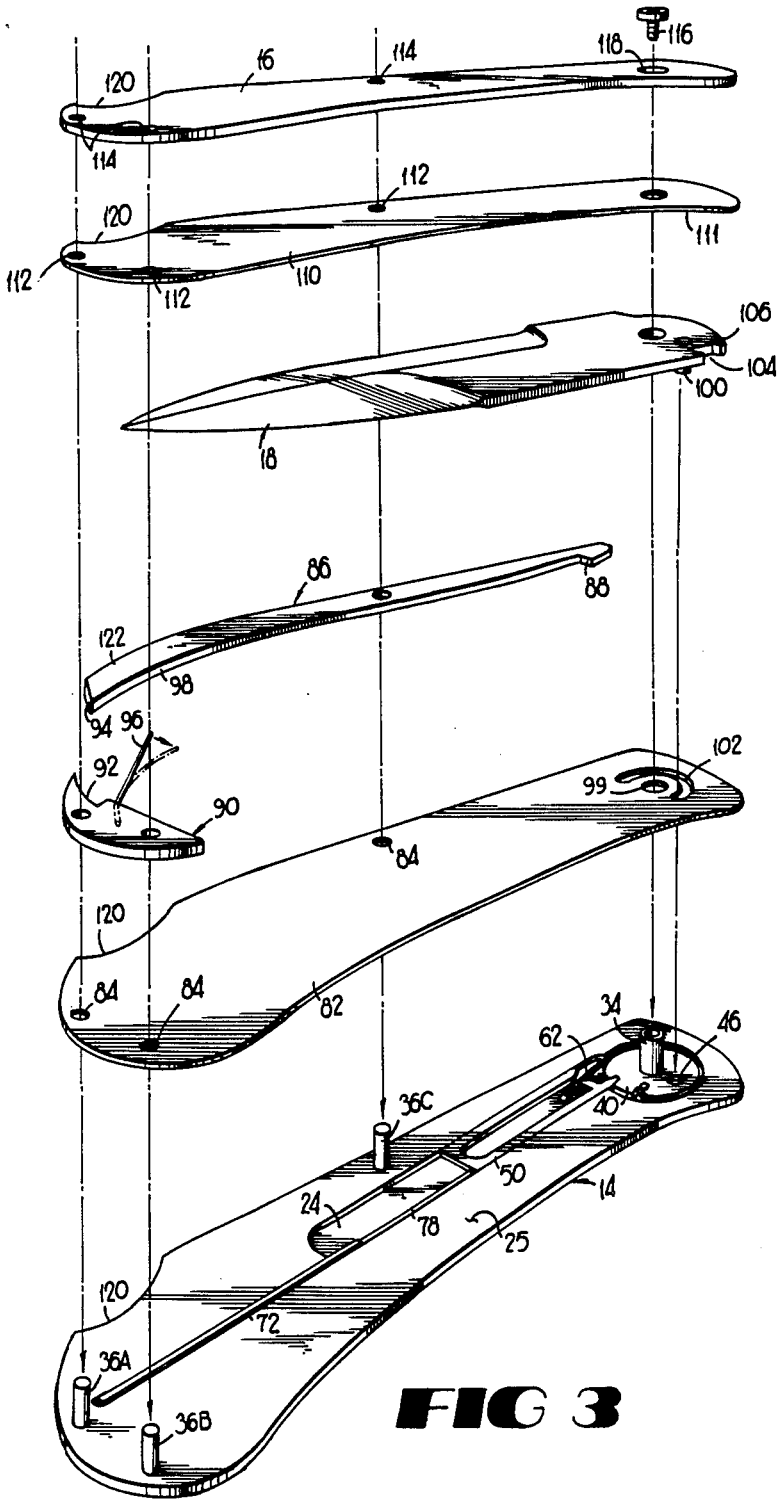
FIG. 3 is an exploded view of the knife of FIG. 1 with the blade closed.

Referring now to FIG. 3, a first spacer plate 82 is mounted to the inner face 25 of the housing section 14 to maintain the wheel 40, cable 62, actuator 50, and spring housing 72 within the recess 24. Holes 84 in the spacer plate 82 receive the guide pins 36 protruding upwardly from the housing section 14 to maintain the spacer plate in coextensive relation with the housing section.

A blade locking member 86 is pivotally mounted onto the intermediate guide pin 36C protruding upwardly through the first spacer plate 82. The locking member 86 has a latch element 88 formed in one end thereof. Mounted adjacent to the locking member 86 is a heel member 90 fixedly mounted on the two end guide pins 36A, 36B. The heel member 90 has a recess 92 disposed to receive the end 94 of the locking member 86. A spring 96 projecting from an aperture in the heel member 90 bears against the lower edge 98 of the locking member 86 to bias the end 94 of the locking member outwardly from the casing 12. The end 94 limits travel of the blade locking member 86.

The blade 18 is pivotally mounted on the pivot post 34 protruding upwardly through the circular opening 99 near one end of the first spacer plate 82. The blade 18 has a pin 100 formed on the bottom thereof, which pin protrudes downwardly through an arcuate slot 102 in the first spacer plate 82 to engage the hole 46 in the wheel 40. The arcuate slot 102 is concentric to the opening 99 in the first spacer plate 82. In this manner, as the wheel 40 turns, the blade 18 pivots therewith. The blade 18 further includes a notch 104 and a camming surface 106 formed at the outside surface on the pivoting end of the blade.

A second spacer plate 110 is mounted atop the pivotally mounted blade 18, locking member 86, and heel member 90. The second housing section 16 is mounted on top of the second spacer plate 110, with holes 112, 114 in the second spacer plate and second housing section receiving the guide pins 36 to align the second spacer plate and second housing section with the first spacer plate and first housing section. The threaded shank of a screw 116 is inserted through a hole 118 in the second housing section 16 to threadingly engage the upper end of the pivot post 34, which abuts the inner surface 111 of the second housing section and maintains proper clearance between the housing sections and the pivoting end of the blade 18, to clamp the various elements of the knife together.

Figure 4:
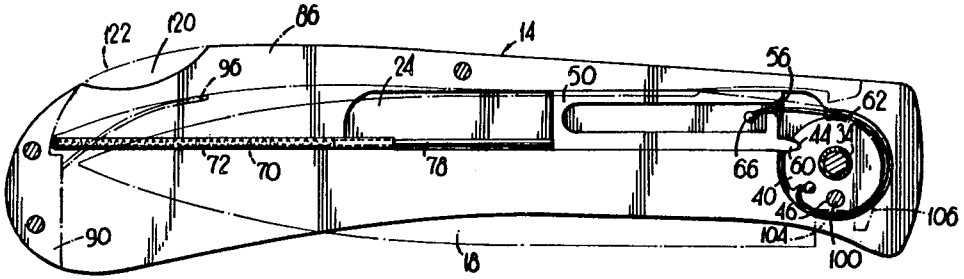
FIG. 4 is a sectioned plan view of the knife of FIG. 1 depicting the blade in a closed and locked position.
Figure 5:
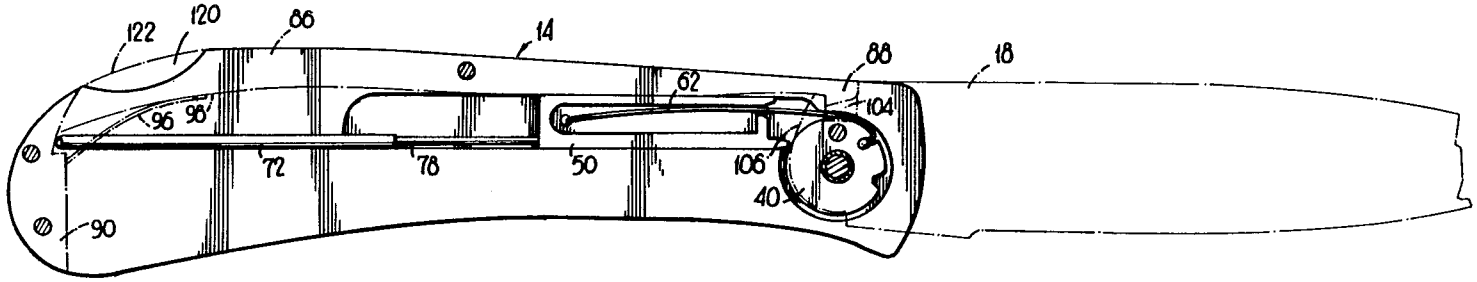
FIG. 5 is a sectioned plan view of the knife of FIG. 1 depicting the blade in an open and locked position.

As can perhaps best be seen in FIG. 1, the housing sections 14, 16 and the spacer plates 82, 110 have arcuate cutouts, collectively designated as 120, near the heel of the knife, through which a portion 122 of the blade locking member 86 is exposed. When the exposed portion 122 of the blade locking member 86 is depressed,the blade locking member pivots in a counterclockwise direction as seen in FIGS. 3–5 to disengage the latch element 88 from the notch 104 in the pivoting end of the blade 18. When the portion 122 of the locking member 86 is released, the spring 96 biases the locking member to its normal position.

Referring now to FIG. 4, with the knife blade in the closed position, the locking member 60 is biased into engagement with the detent 44 in the wheel 40 to prevent the wheel from turning. With the pin 100 formed on the lower edge of the knife blade engaging the hole 46 in the wheel 40, the blade is thus prevented from opening.

To open the knife 10 of the present invention, a user grasps the knife in one hand with the side of the casing from which the blade is pivoted facing away from the palm of the hand. The user then presses the actuator button 20 toward the heel of the knife to slide the actuator 50 within the recess 24. As can be seen in FIG. 3, with the blade in the closed position, there is a small amount of slack in the cable 62 near the ferrule 66 such that the cable will slide within the slot 56 of the actuator 50 for a short distance before the ferrule on the end of the cable is engaged by the moving actuator. Accordingly, during the first portion of the travel of the actuator 50, the locking element 60 is extracted from the detent 44 in the wheel 40, but the cable 62 is not being pulled to rotate the wheel. In this manner, the knife opening mechanism provides for unlocking the blade from its locked position prior to initiating any rotational movement of the blade.

With the locking element 60 thus disengaged, further movement of the actuator 50 creates a tension on the cable 62 which causes the wheel 40 to rotate on the pivot post 34 in a counterclockwise position as shown in FIG. 3. The wheel 40 in the disclosed embodiment is circular, giving uniform angular velocity in response to pulling the cable 62 at a constant rate. However, the circumference of the wheel 40 may be alternatively be eccentric with respect to the axis of rotation of the wheel, so as to provide variable ratios between movement of the actuator button 20 and rotation of the blade 18. As the wheel rotates, the pin 100 engaging the hole 46 in the wheel causes the blade to pivot outwardly from the casing. The camming surface 106 on the pivoting end of the blade 18 is eccentrically positioned so as not to contact the latch element 88 until the blade nears the fully open position, thereby reducing frictional force on the blade during most of its opening movement.

Referring now to FIG. 4, as the blade 18 rotates toward the fully opened position, the camming surface 106 on the pivoting end of the blade bears against the latch element 88 of the locking member 86 and causes the locking member to pivot about its mounting post in a counterclockwise direction as seen in FIG. 4. As the blade rotates further, the latch element 88 encounters the notch 104 in the pivoting end of the blade. The leaf spring 96 bearing against the lower end 98 of the locking member 86 causes the locking member to pivot in a clockwise direction, biasing the latch element 88 into engagement with the notch 104 in the pivoting end of the blade. As the user releases the actuator button 20, the coil spring within the spring housing 72 bears against the plunger 78, urging the actuator 50 back to the right as shown in FIG. 4.

To close the knife 10, the portion 122 of the locking member 86 which is exposed through the arcuate recess 120 in the heel of the knife is depressed. As the exposed portion 122 of the locking member 86 is depressed, the locking member pivots in a counterclockwise direction as seen in FIGS. 3–5, disengaging the latch element 88 from the notch 104 in the pivoting end of the blade 18. With the blade thus unlocked, it can now be pivoted in a clockwise direction to fold the blade into the casing 12. The wheel 40 and cable 62 now are returned to their positions shown in FIG. 4.

Figure 6:
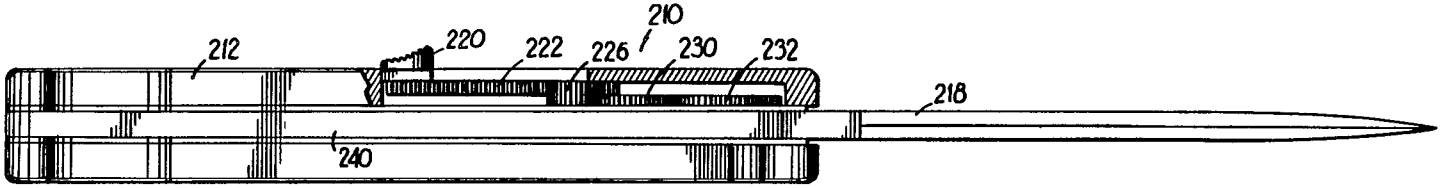
FIG. 6 is a bottom cut-away view of a knife including a knife opening mechanism according to an alternate embodiment of the present invention.
Figure 7:
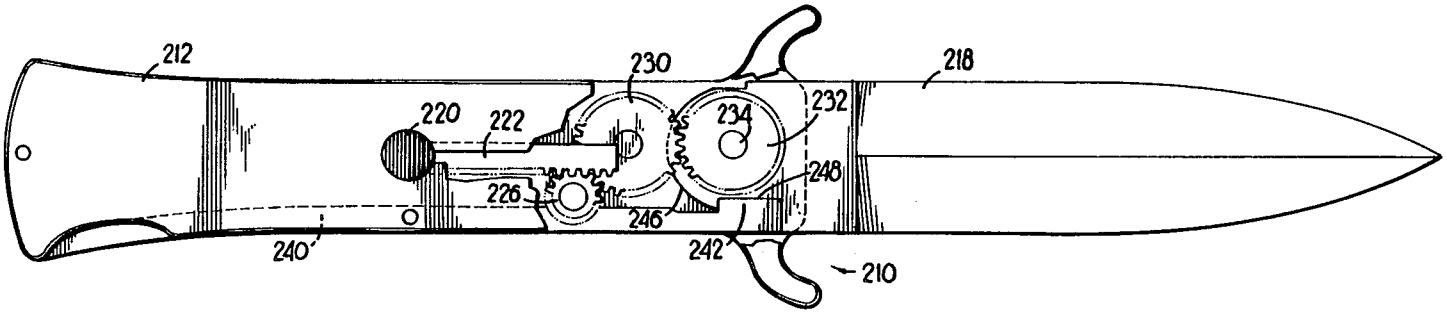
FIG. 7 is a side cut-away view of the knife as seen from the top of FIG. 6.

A knife 210 according to an alternate embodiment of the present invention is shown in FIGS. 6–7. The knife 210 includes a casing 212, a blade 218, and an actuator button 220 slidably mounted on the casing for actuating the knife opening mechanism. As will be seen, the knife 210 of the alternate embodiment differs from the knife 10 of the preferred embodiment in that the blade opening mechanism is driven by a rack and gear arrangement, as opposed to the cable and wheel arrangement of the preferred embodiment.

The actuator button 220 is linked to a gear rack 222 slidably mounted within the casing 212 and having teeth formed on its inner edge. A pinion 226 is rotatably mounted within the casing adjacent to the gear rack 222 such that the teeth on the upper portion of the pinion as seen in FIG. 6 are engaged by the teeth of the gear rack. The lower portion of the pinion 226 engages an intermediate gear 230 rotatably mounted adjacent thereto. The intermediate gear, in turn, engages a blade gear 232 rotatably mounted upon a post 234. The blade 218 is also pivotally mounted to the post 234, and the blade gear 232 and blade are linked to turn together, such as by a pin-and-hole arrangement as hereinabove described for the wheel 40 and blade 18 of the preferred embodiment.

The knife 210 further includes a pivotally mounted locking member 240 having a latch element 242 at one end thereof, which interacts with a camming surface 246 and notch 248 on the pivoting end of the blade to lock the blade in the opened position in the same manner as hereinabove described for the knife 10 of the preferred embodiment.

To operate the knife 210 of the alternate embodiment, the user presses the actuator button 220 to the right as seen in FIGS. 6 and 7. The gear rack 222 is thereby moved toward the right, the teeth of the gear rack engaging the teeth on the upper portion of the pinion 226 to drive the pinion in a clockwise direction as seen in FIG. 7. The lower portion of the pinion 226 engages the intermediate gear 230 to drive it in a counterclockwise direction. In turn, the intermediate gear 230 engages the blade gear 232, turning it in a clockwise direction and causing the blade 218 to pivot therewith. When the blade is pivoted into its fully opened position, the latch element 242 engages the notch 248 in the pivoting end of the blade to lock the blade in the opened position.

It will be appreciated by those skilled in the art that the ratios between the various gears can be controlled to provide an actuator button stroke of suitable length for comfortably opening and closing the blade. It also will be understood that the embodiment shown in FIGS. 6 and 7 opens by moving the actuator button 220 in the same direction as the desired opening movement of the blade 218, that is, toward the right as seen in those Figures.

While the knife 210 of the alternate embodiment is disclosed with respect to a drive train including both a pinion gear 226 and an intermediate gear 230 drivably connecting the gear rack 222 and the blade gear 232, it will be appreciated that the gear rack and the blade gear can also be drivably linked by the pinion only, relocated to engage both the gear rack and the blade gear. In such an embodiment, the pinion can be relocated to the opposite side of the gear rack, if desired, to maintain the opening direction of the actuator button in the same direction as the desired opening movement of the blade.

It should be understood that the terms "upper", "lower", "above", "below", "clockwise", "counterclockwise", and the like are used herein only for convenience of description and do not limit the invention to any particular orientation of a knife embodying the blade opening mechanism.

Finally, it will be understood that the preferred embodiment of the present invention has been disclosed by way of example, and that other modifications may occur to those skilled in the art without departing from the scope and spirit of the appended claims.

What is claimed is:

1. A folding knife comprising:

a casing;

a blade pivotably mounted to said casing and having a closed position and an open position with respect thereto;

a wheel operatively associated with said blade such that rotating said wheel pivots said blade with respect to said casing;

an actuator slidably mounted to said casing for actuation by a user; and a non-extensible linkage attached to said actuator and wrapped around a portion of the circumference of said wheel such that when a user exerts a force against said actuator to slide said actuator with respect to said casing, said user-exerted force is transmitted to said non-extensible linkage wrapped around a portion of said wheel, whereby said user-exerted force is converted into a rotational force by said wheel to rotate said blade from said closed position to said open position.

2. The folding knife of claim 1, further comprising means for normally locking said blade in said closed position, said locking means being selectively unlockable in response to actuation of said actuator to permit said blade to pivot from said closed position to said open position.

3. The folding knife of claim 2, wherein said wheel has a detent formed in the circumference thereof, and wherein said means for normally locking said blade in said closed position comprises a locking member normally biased into engagement with said detent in said circumference of said wheel to prevent said wheel from turning, said locking member being operatively associated with said actuator such that said locking member is disengaged from said detent upon actuation of said actuator to permit said wheel to turn.

4. The folding knife of claim 3, wherein said non-extensible linkage attached to said actuator and wrapped around a portion of the circumference of said wheel has a sufficient amount of play relative to said actuator such that, when said actuator is actuated by a user, said non-extensible linkage does not apply said tension to rotate said wheel and said blade associated therewith until said locking member is disengaged from said detent.

5. The folding knife as in claim 1, further comprising:

a blade locking member having a latch element maintained out of contact with said blade while said blade is in said closed position;

a cam surface operatively associated with said blade to move into contact with said latch element as said knife blade is rotated to approach said open position; and means operatively associated with said cam surface to engage said latch element when said knife blade arrives at said open position, thereby selectibly retaining said knife blade at said open position.

6. The folding knife as in claim 5, wherein said blade locking member comprises a lever supporting said latch element and movably mounted in said casing, and wherein said knife further comprises:

means biasing said lever to urge said latch element toward contact with said cam surface; and a stop surface located on said locking member to limit the movement of said locking member caused by said biasing means, said limited movement keeping said latch element out of contact with said cam surface until said knife blade is rotated to approach said open position, such that the latch element does not impart friction to said knife blade when said knife blade is initially rotated from said closed position.

7. The folding knife as in claim 1, wherein said casing comprises first and second housing sections in mutually spaced apart relation, and wherein said knife further comprises a post disposed between said housing sections and having first and second ends, the first end of said post engaging the first housing section and the second end of said post engaging said second housing section such that said post maintains a predetermined spacing between said housing sections, said wheel being rotatably mounted on said post such that said wheel is rotatably disposed between said housing sections.

* * * * *